US006130019A

United States Patent [19]

Nishikawa et al.

[11] Patent Number: 6,130,019

[45] Date of Patent: Oct. 10, 2000

[54] BINDER CARRIER

[75] Inventors: Tomoharu Nishikawa, Hirakata; Makoto Kobayashi, Kobe; Koichi Takenaka, Itami; Hideaki Yasunaga, Sakai; Hiroyuki Fukuda, Sanda; Haruhiko Furukawa, Ichihara; Hiroshi Ueki, Ichihara; Yoshitsugu Morita, Ichihara, all of Japan

[73] Assignee: Minolta Co., Ltd., Osaka, Japan

[21] Appl. No.: 09/201,771

[22] Filed: Dec. 1, 1998

[30] Foreign Application Priority Data

Dec. 12, 1997 [JP] Japan ..... 9-342640

[51] Int. Cl.[7] ..... G03G 9/10

[52] U.S. Cl. ..... 430/108; 430/106.6

[58] Field of Search ..... 430/106.6, 108

[56] References Cited

U.S. PATENT DOCUMENTS

| | | | |
|---|---|---|---|
| 4,111,823 | 9/1978 | Kobayashi et al. | 430/111 |
| 4,600,675 | 7/1986 | Iwasa et al. | 430/106.6 |
| 4,791,041 | 12/1988 | Aoki et al. | 430/108 |
| 4,847,176 | 7/1989 | Sano et al. | 430/106.6 |
| 5,110,703 | 5/1992 | Nagatsuka et al. | 430/108 |
| 5,536,782 | 7/1996 | Takarada et al. | 430/106.6 |
| 5,731,120 | 3/1998 | Tanigami et al. | 430/108 |

FOREIGN PATENT DOCUMENTS

| | | |
|---|---|---|
| 0 362 710 A2 | 4/1990 | European Pat. Off. . |
| 58-167606 | 10/1983 | Japan . |

OTHER PUBLICATIONS

Diamond, Arthur S. (editor) Handbook of Imaging Materials. New York: Marcel–Dekker, Inc. pp. 169–170.

*Primary Examiner*—Christopher D. RoDee
*Attorney, Agent, or Firm*—Burns, Doane, Swecker & Mathis, LLP

[57] ABSTRACT

The present invention relates to a binder carrier comprising at least magnetic particles and a binder resin. The binder resin contains a thermoplastic silicone-modified acrylic resin which is a copolymer of a polydiorgano-siloxane macromer having an acrylic functional group and a radical-polymerizable organic monomer.

The binder carrier of the present invention a long-life binder carrier which eliminates the possibility of carrier deterioration due to toner components, such as a charge-controlling agent and an after-treatment agent, and which is less liable to deteriorate in its chargeability.

25 Claims, 2 Drawing Sheets

BINDER CARRIER

This application is based on application No. Hei 09-342640 filed in Japan, the contents of which are hereby incorporated by reference.

BACKGROUND OF THE INVENTION

1. Field of the Invention

The present invention relates to a carrier for use as a two-component developer in image-forming apparatuses such as a digital copying machine and a printer and, more particularly, to a binder carrier containing magnetic particles dispersed in a binder resin.

2. Description of the Related Art

In electrophotographic apparatuses, such as copying machines and printers, the process of two-component development utilizing a two-component developer comprised of a toner and a magnetic carrier has been in general practice for development of an electrostatic latent image formed on an image-supporting member, such as a photosensitive member.

A variety of carriers for two-component developer are known including iron powder carriers, ferrite carriers, resin-coated carriers containing those magnetic particles coated with resin, and binder carriers having magnetic fine particles dispersed in binder resin. However, resin-coated carriers involve a problem such that when the carrier is transported in the form of a magnetic brush on a developing roller, the crest of the brush is so hard as to prevent the formation of a smooth image. Another problem is that scraping operation of the magnetic brush may cause the trouble of toner image disturbance and may damage the photoreceptor member. Resin-coated carriers involve a further problem such that as the carrier is used as such, its coat layer tends to peel off, so that the useful life of the developer is rendered short.

Binder carriers are receiving considerable attention because such a carrier can not only solve above noted problems, but is readily adaptable for particle size reduction and has high electric volume resistivity so that it is hardly injected by electrical charges from the developer-supporting member.

A conventional binder carrier, however, has such a problem that in the course of use of the binder carrier, toner components, such as a charge-controlling agent and an after-treatment agent, tend to adhere to the surface of the carrier, thus causing deterioration of the charging capability of the carrier, with the result that the toner cannot be sufficiently charged. This leads to the occurrence of image noise, such as fogging, with respect to the image formed on a copy sheet.

SUMMARY OF THE INVENTION

It is an object of the invention to provide a long-life binder carrier which eliminates the possibility of carrier deterioration due to toner components, such as charge-controlling agents and after-treatment agents, and which demonstrates less deterioration in its charging capability.

The present invention provides a binder carrier comprising at least magnetic particles and a binder resin, the binder resin containing a thermoplastic silicone-modified acrylic resin.

DETAILED DESCRIPTION OF THE INVENTION

Figure 1:
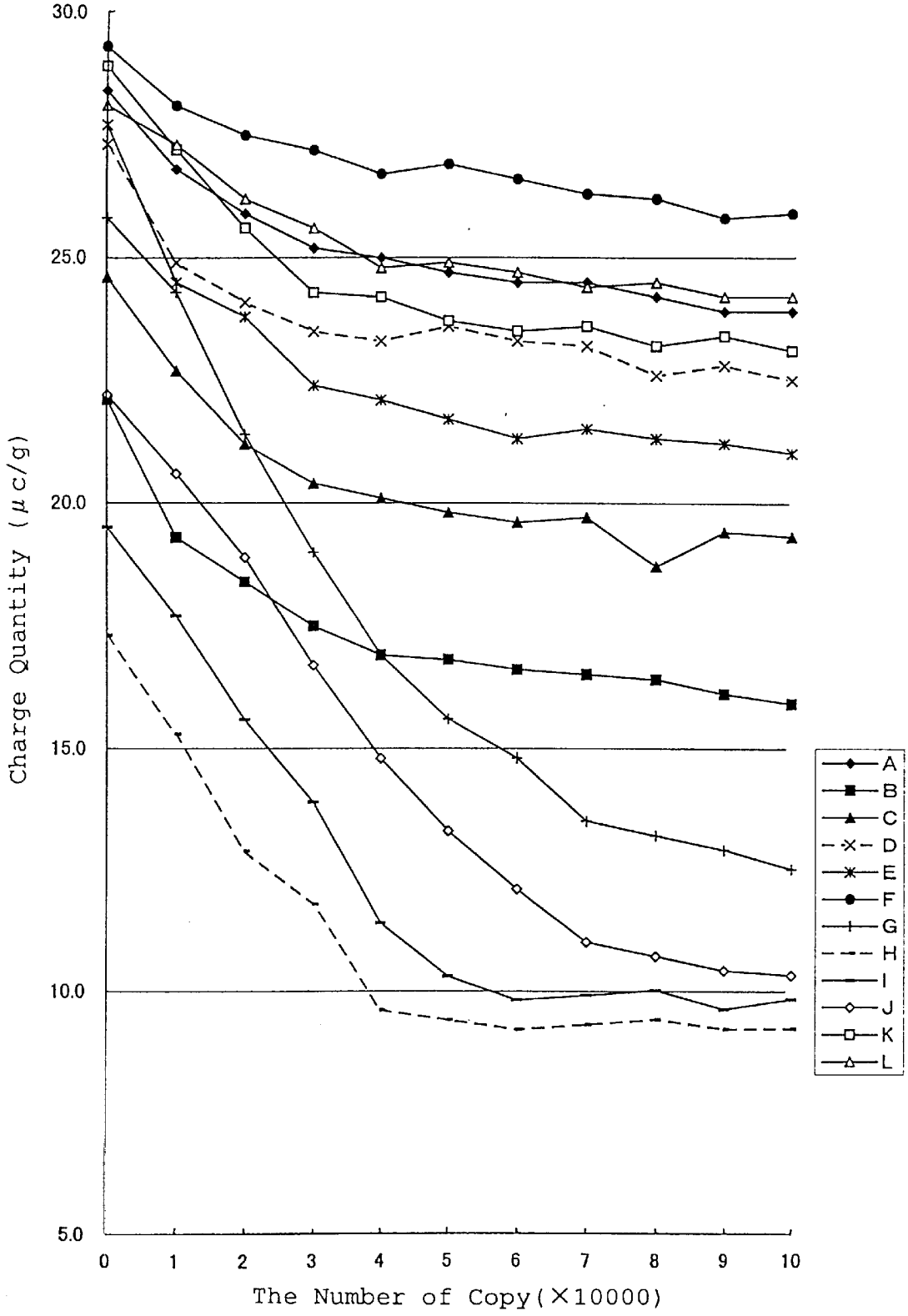
FIG. 1 is a graph showing changes in electrical charge amount of toner relative to the number of printed copy sheets in durability test.

The present invention relates to a binder carrier comprising at least magnetic particles and a binder resin, the binder resin comprising a thermoplastic silicone-modified acrylic resin.

According to the present invention, the acrylic component of the thermoplastic silicone-modified acrylic resin effects to improve the compatibility of the binder resin with other binder resin, thereby to improve the dispersibility and integrity of the silicone-modified acrylic resin and magnetic particles relative to the binder resin. At the same time, the silicone component acts to prevent carrier deterioration due to toner components.

In the present invention, the silicone-modified acrylic resin is a copolymer resin of a polydiorgano-siloxane macromer having an acrylic functional group with a radical-polymerizable organic monomer.

The polydiorgano-siloxane macromer having an acrylic functional group is represented by the general formula (I)

(I)

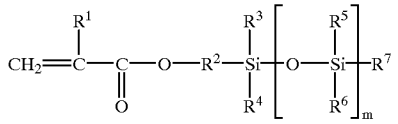

In the above formula, $R^1$ represents a hydrogen atom or an alkyl group. For the alkyl group, lower alkyl groups of C1 to C4, preferably C1 and C2, maybe exemplified. Particularly, a methyl group is preferred.

$R^2$ represents an alkylene group. For the alkylene group, a lower alkylene groups of C1 to C5, preferably C2 to C4, may be exemplified. Particularly, a propylene group is preferred.

Each group of $R^3$–$R^6$ represents respectively a monovalent hydrocarbon group and may be identical with or different from the others. For the monovalent hydrocarbon group, a lower alkyl group of C1 to C4, preferably C1–C2, an aryl group such as a phenyl group; a halogenated alkyl group, such as 3, 3, 3-trifluoropropyl group; and an alkenyl groups, such as a vinyl group and an allyl group, may be exemplified. In particular, $R^3$–$R^6$ are preferably identical with one another and are respectively a methyl group.

$R^7$ represents a group selected from the group consisting of a monovalent hydrocarbon group, a hydroxyl group, and an acrylic functional group represented by the general formula (II):

(II)

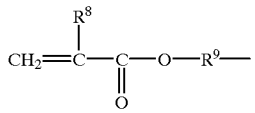

For the monovalent hydrocarbon group, a lower alkyl group of C1–C4, preferably C1–C2, may be exemplified. In particular, a methyl group is preferred. In the formula (II), $R^8$ represents a hydrogen atom or an alkyl group. For the alkyl group, a lower alkyl group of C1–C4, preferably C1–C2, may be exemplified. In particular, a methyl group is preferred. $R^9$ represents an alkylene group. For the alkylene group, a lower alkylene group of C1–C5, preferably C2–C4, maybe exemplified. In particular, a propylene group is preferred.

In the formula (I), m is an integer of 1 to 500, preferably 25 to 300, more preferably 50 to 200.

When the polydiorgano-siloxane macromer having an acrylic functional group is such that in the general formula (I), $R^7$ is a monovalent hydrocarbon group or a hydroxyl group, the polydiorgano-siloxane macromer is produced in such a way that by using a lithium salt of organosilane represented by the general formula:

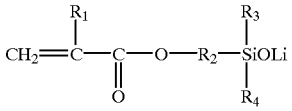

as a polymerization initiator, a cyclic trisiloxane represented by the general formula:

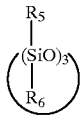

is polymerized in non-equilibrium conditions so as to be terminated by an acid or a triorgano-chlorosilane represented by the general formula:

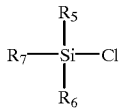

(see EP362710).

When $R^7$ is expressed by the general formula (II), a polydiorgano-siloxane macromer is produced by a polycondensation of 1 mole of an organo-chlorosilane represented by the following general formula:

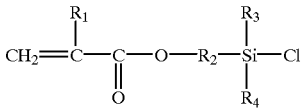

and 1 mole of an organo-chlorosilane represented by the following general formula:

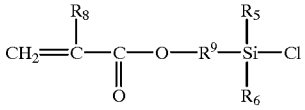

relative to 1 mole of an organo-polysiloxane represented by the following general formula:

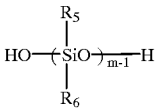

(see Japanese Patent Application Laid-Open No. Sho 58-167606).

The radical-polymerizable organic monomer which is copolymerized with the polydiorgano-siloxane macromer having the acrylic functional group is an acrylic organic monomer represented by the general formula (III):

(III)

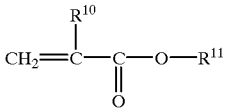

In general formula (III), $R^{10}$ represents a hydrogen atom or an alkyl group. For the alkyl group, a lower alkyl group of C1–C4, preferably C1–C2, maybe exemplified. In particular, a methyl group is preferred. $R^{11}$ represents a monovalent hydrocarbon group. For the monovalent hydrocarbon group, a lower alkyl group of C1–C4, preferably C1–C2 maybe exemplified. In particular, a methyl group is preferred.

The silicone-modified acrylic resin for use in the present invention can be produced by copolymerizing the above mentioned polyorgano-siloxane macromer (I) having an acrylic functional group with the above mentioned radical-polymerizable organic monomer (III) in the presence of azobisisobutyronitrile (AIBN).

In this conjunction, it is preferable that a polyorgano-siloxane represented by the following general formula (IV) is present in the polymerization reaction.

(IV)

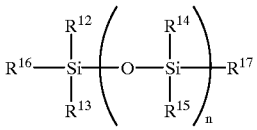

In the above formula (IV), $R^{12}$–$R^{15}$ each may be identical with or different from the others and represent a monovalent hydrocarbon group. For the monovalent hydrocarbon group may be exemplified an alkenyl group, such as a vinyl group and an allyl group; a aryl group, such as a phenyl group; a halogenated alkyl group, such as 3, 3, 3-trifluoropropyl group, a lower alkyl group of C1–C4, preferably C1–C2. It is particularly desirable that $R^{12}$–$R^{15}$ be identical, each being a methyl group. $R^{16}$ and $R^{17}$ represent independently a monovalent hydrocarbon group or a hydroxyl group. For the monovalent hydrocarbon group, a lower alkyl group of C1–C4, preferably C1–C2, are exemplified. It is especially desirable that $R^{16}$ and $R^{17}$ are identical, each being a methyl group.

In the formula (IV), n denotes an integer of 1–500, preferably 25–300, more preferably 50–200.

The polyorgano-siloxane represented by the formula (IV) is a well known compound which can be obtained by an equilibrium reaction of a low molecular-weight cyclic diorgano-polysiloxane in the presence of an acid or alkali catalyst or by an equilibrium reaction of a low molecular-weight cyclic diorgano-polysiloxane with a low molecular-weight linear diorgano-polysiloxane in the presence of an acid or alkali catalyst. As an example of such a polyorgano-siloxane, polydimethyl polysiloxane is commercially available under the trade name of SH200 oil, a product made by Toray Dow Corning Silicone K.K.

When the polyorgano-siloxane (IV) is contained, an amount of the polyorgano-siloxane is 1/8–1, preferably 1/4–1/2, relative to the polydiorgano-polysiloxane macromer (I). Ultimately, the silicone-modified acrylic resin is a copolymer produced by copolymerizing a polydiorgano-siloxane macromer having an acrylic functional group represented by the general formula (I) and an acrylic organic monomer represented by the general formula (III) in the presence or absence of a polyorgano siloxane represented by the general formula (IV), the silicone-modified acrylic resin being such that the ratio (Mac/Msi) of a repeating unit (Mac) expressed by the following formula:

(Mac)

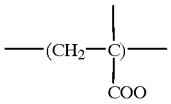

to a repeating unit (Msi) expressed by the following formula:

(Msi)

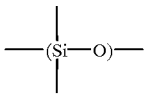

is within the range of 1/4 to 4/1. Preferably, the ratio is within the range of 1/3 to 3/1, more preferably within the range of 1/2 to 2/1.

If the ratio of Mac/Msi is less than 1/4, the production adaptability of the silicone-modified acrylic resin is lowered. If the ratio is more than 4/1, no sufficient effect of preventing adhesion of toner components, such as a charge-controlling agent and an after-treatment agent, to the carrier surface could be obtained.

The binder resin which constitutes a carrier of the present invention comprises a mixture of a silicone-modified resin and other binder resin.

In the present invention, a content of the silicone-modified acrylic resin is in the range of about 5 to about 70% by weight, preferably about 10 to about 50% by weight, relative to the total weight of the binder resin. By using a binder resin containing the silicone-modified resin in the above mentioned proportion, it is possible to prevent adhesion of toner components, such as a charge-controlling agent and an after-treatment agent, to the surface of the carrier. Thus, such problems as toner dusting and fogging, and unsatisfactory charging of replenished toner can be eliminated. If the content of the silicone-modified acrylic resin is less than about 5% by weight, such effect of the silicone-modified acrylic resin as above mentioned could not sufficiently be obtained. If the content of the silicone-modified resin is more than about 70% by weight, the productivity would be lowered.

For other binder resin to be used in conjunction with the silicone-modified acrylic resin, various kinds of conventional resins may be used including, for example, polyester resins, styrene-acrylic copolymer resins, poly (meth) acrylic resins, and epoxy resins. Among these kinds of resins, poly (meth) acrylic resins are preferred which can be advantageously used in both positively chargeable and negatively chargeable toners. In order that the positively or negatively charging level may be stably set at a high level, it is desirable to use polyester resin, epoxy resin etc. in case that the carrier of the present invention is used in combination with a positively chargeable toner, or to use styrene-acrylic copolymer resin etc. in case that the carrier is used in combination with a negatively chargeable toner.

The carrier of the present invention may be produced, for example, as follows. A binder resin and magnetic particles are heated and mixed in a specified mixing ratio (100 to 900 parts by weight, preferably 300 to 700 parts by weight, of magnetic particles relative to 100 parts by weight of binder resin), the mixture is then cooled, pulverized and classified. The binder resin may be dissolved in a solvent, and magnetic particles are dispersed into the resulting solution, followed by spraying and drying. In this way, a carrier having a volume-mean particle size of 20 to 100 $\mu$m, preferably 30 to 80 $\mu$m, can be obtained.

It is desirable that the carrier has a saturation magnetization level of 30 to 80 emu/g, preferably 35 to 65 emu/g, more preferably 40 to 60 emu/g. The reason for this is that when the saturation magnetization level of the carrier is low, magnetic force of the carrier attracted to the developer-transporting member is reduced, so that the carrier get liable to adhere to an image-supporting member. If saturation magnetization of the carrier is too high, the carrier partially agglomerates on the developer transporting-member, so that it becomes unable to form a uniform developer thin layer. As a result, the formed image may have irregularity in density, and image reproducibility is lowered with respect to halftone image and high precision image.

Magnetic particles usable for the carrier include, for example, metals such as iron, nickel, and cobalt, and ferrite and magnetite. Among these materials, magnetite is particularly preferred. From the standpoint of its uniform dispersion in the binder resin, it is desirable that these magnetic particles have a primary mean particle size of not more than 5 $\mu$m, preferably not more than 2 $\mu$m, more preferably 0.1 to 1 $\mu$m.

The carrier may contain dispersants, such as carbon black, silica, titania, and alumina. Such a dispersant may enhance uniform dispersibility of magnetic particles in the binder resin. A dispersant content is preferably 0.01 to 3% by weight relative to the carrier.

A toner content of the developer is 3 to 20% by weight, preferably 5 to 10% by weight, relative to the carrier.

If the toner content is less than 3% by weight, no sufficient image density could be obtained, and the toner may be excessively charged. If the toner content is more than 20% by weight, toner may not be sufficiently charged, with the result that there may easily occur fogging in copied images.

EXAMPLES

The following examples are given to further illustrate the invention. It is to be noted that as materials for preparation of silicone-modified acrylic resin were used three types of diorgano-polysiloxane which respectively had structures represented by the following formulas.

Polydimethylsiloxane A:

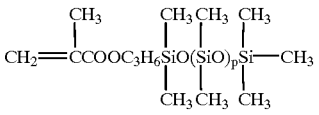

(in which, p denotes the number of repeating units of dimethyl siloxane).

Polydimethylsiloxane B:

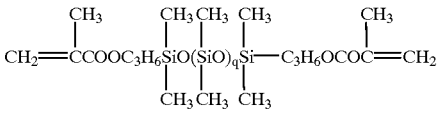

(in which, q denotes the number of repeating units of dimethyl siloxane).

Polydimethylsiloxane C:

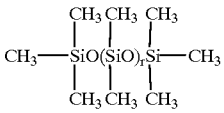

(in which, r denotes the number of repeating units of dimethyl siloxane).

Preparation of Silicone-Modified Acrylic Resin a

Into a4-necked 200 ml flask equipped with an agitator, a thermometer, and a reflux condenser were charged 6.40 g of polydimethylsiloxane A (p=100), 3.20 g of polydimethylsiloxane B (q=100), 3.20 g of polydimethylsiloxane C (r=100), 17.20 g of methyl methacrylate, and 70 g of toluene, and the materials were heated to 70° C. under stirring in a nitrogen atmosphere. Thereafter, 0.30 g of α, α'-azobisisobutyronitrile (hereinafter referred to as AIBN) was added, and stirred and heated for 6 hours. A part of the polymeric liquid was sampled and examined to determine a quantity of unreacted methyl methacrylate by gas chromatography. The quantity of unreacted material was not more than 4% of the added amount.

Then, the toluene solution was heated and agitated to remove toluene partially by an aspirator under vacuum. Then, the toluene solution was transferred into a stainless steel saucer and was dried under vacuum. Thus, silicone-modified acrylic resin a was obtained.

An $^1$H-nucleus magnetic resonance (hereinafter referred to as NMR) analysis gave the result that Mac/Msi in the silicone modified acrylic resin a was 1/1.

Preparation of Silicone-Modified Acrylic Resin b

Into a 4-necked 200 ml flask equipped with an agitator, a thermometer, and a reflux condenser were charged 2.96 g of polydimethylsiloxane A (p=50), 1.47 g of polydimethylsiloxane B (q=50), 1.47 g of polydimethylsiloxane C (r=50), 24.10 g of methyl methacrylate, and 70 g of toluene, and were heated to 70° C. under stirring in a nitrogen atmosphere. Thereafter, 0.30 g of AIBN was added, heated and stirred for 6 hours. A part of the polymeric liquid was sampled and examined to determine a quantity of unreacted methyl methacrylate by gas chromatography.

The quantity of the unreacted material was not more than 4% of the added amount. Then, the toluene solution was heated and agitated to remove the toluene partially by an aspirator under vacuum. Then the toluene solution was transferred into a stainless steel saucer and was dried in vacuum. Thus, silicone-modified acrylic resin b was obtained.

An IH-NMR analysis gave the result that Mac/Msi in the silicone modified acrylic resin b was 3/1.

Preparation of Silicone-Modified Acrylic Resin c

Into a 4-necked 200 ml flask equipped with an agitator, a thermometer, and a reflux condenser were charged 10.36 g of polydimethylsiloxane A (p=150), 5.17 g of polydimethylsiloxane B (q=150), 5.17 g of polydimethylsiloxane C (r=150), 9.30 g of methyl methacrylate, and 70 g of toluene, and heated to 70° C. under stirring in a nitrogen atmosphere. Thereafter, 0.30 g of AIBN was added to the solution, and stirred and heated for 6 hours. A part of the polymeric liquid was sampled and examined to determine a quantity of unreacted methyl methacrylate by gas chromatography. The quantity of unreacted material was not more than 4% of the added load. The toluene solution heated and agitated to remove toluene partially by an aspirator under vacuum. Then, the toluene solution was transferred into a stainless steel saucer and was dried under vacuum. Thus, silicone-modified acrylic resin c was obtained.

An IH-NMR analysis gave the result that Mac/Msi in the silicone modified acrylic resin c was 1/3.

Carrier Preparation Example

Seventy parts by weight of polyester resin (softening point: 121° C.; glass transition point: 67° C.), 30 parts by weight of silicone-modified acrylic resin a, and 500 parts by weight of magnetic particles (MFP-2, made by TDK K.K.) were thoroughly mixed in a Henschel mixer. The mixture was kneaded in a vent twin-screw kneader. After having been cooled, the kneaded mixture was roughly pulverized by a feather mill. Then, the coarse particles were finely pulverized in a jet mill. The pulverized particles were classified by an air classifier to give a carrier A having a volume-mean particle size of 60 μm.

Subsequently, carriers B to L were produced by using resins shown in Table 1 under same manufacturing conditions.

Volume-mean particle size measurements of the carriers were made by means of a Coulter multicizer (made by Coulter K.K.) with an aperture tube of 280 μm.

TABLE 1

| Carrier | | Parts | | Parts |
|---|---|---|---|---|
| A | Poryester resin (Tg: 67° C., Tm: 121° C. | 70 | silicone-modified acrylic resin a | 30 |

TABLE 1-continued

| Carrier | | Parts | | Parts |
|---|---|---|---|---|
| B | Styrene-n-butyl methacrylate resin (Tg: 60° C., Tm: 132° C. | 70 | silicone-modified acrylic resin a | 30 |
| C | n-butyl methacrylate resin (Tg: 60° C., Tm: 140° C.) | 70 | silicone-modified acrylic resin a | 30 |
| D | Epoxy resin (Tg: 58° C., Tm: 138° C. | 70 | silicone-modified acrylic resin a | 30 |
| E | Poryester resin (Tg: 67° C., Tm: 121° C. | 90 | silicone-modified acrylic resin a | 10 |
| F | Poryester resin (Tg: 67° C., Tm: 121° C. | 50 | silicone-modified acrylic resin a | 50 |
| G | Poryester resin (Tg: 67° C., Tm: 121° C. | 100 | silicone-modified acrylic resin a | 0 |
| H | Styrene-n-butyl methacrylate resin (Tg: 60° C., Tm: 132° C. | 100 | silicone-modified acrylic resin a | 0 |
| I | n-butyl methacrylate resin (Tg: 60° C., Tm: 140° C. | 100 | silicone-modified acrylic resin a | 0 |
| J | Epoxy resin (Tg: 58° C., Tm: 138° C. | 100 | silicone-modified acrylic resin a | 0 |
| K | Poryester resin (Tg: 67° C., Tm: 121° C. | 70 | silicone-modified acrylic resin b | 30 |
| L | Poryester resin (Tg: 67° C., Tm: 121° C. | 70 | silicone-modified acrylic resin c | 30 |

Toner Preparation Examples

Toner a

One hundred parts by weight of styrene-n-butyl methacrylate resin (softening point: 132° C.; glass transition point: 60° C.), 3 parts by weight of carbon black (MA#8, made by Mitsubishi Kagaku K. K.), and 5 parts by weight of nigrosine dye (Bontron N-10, made by Orient Kagaku Kogyo K. K.) were thoroughly mixed in a Henschel mixer. The mixture was then kneaded in a vent twin screw kneader. After cooled, the kneaded mixture was pulverized roughly in a feather mill. The resulting particles was then pulverized finely in a jet mill. The pulverized particles were classified by an air classifier. As a result, black fine particles having a volume-mean particle size of 11 μm were obtained. To 100 parts by weight of the black fine particles was added 0.3 parts by weight of hydrophobic silica (R972, made by Nippon Aerosil K.K.). The mixture were treated in a Henschel mixer at 1000 rpm for 1 minute. A positively chargeable toner a was thus obtained.

Toner b

One hundred parts by weight of a thermoplastic polyester resin (softening point: 120° C.; glass transition point: 61° C.), 3 parts by weight of a low molecular weight polypropylene ("Viscol 550", made by Mitsubishi Kagaku K.K.), 5 parts by weight of a negative charge-controlling agent ("Bontron S-34", made by Mitsubishi Kagaku K.K.), and 8 parts by weight of carbon black ("Mogul L", made by Cabot K.K.) were thoroughly mixed in a Henschel mixer. The mixture was kneaded in a vent twin screw kneader. After cooled, the kneaded mixture was pulverized in a feather mill, the resulting particles were then pulverized finely in a jet mill. The pulverized particles were classified by an air classifier. As a result, a black fine particles having a volume-mean particle size of 9 μm was obtained. To 100 parts by weight of the black fine particles were added 0.3 part by weight of hydrophobic silica (H-2000, made by Hoechst Japan K.K.). The mixture was treated in a Henschel mixer at 1000 rpm for 1 minute. A negatively chargeable toner b was thus obtained.

Toner c

A polyester resin (Tg: 58° C., Tm: 100° C.) and a magenta pigment (C. I. pigment red 184) were charged into a press kneader so as to give a resin/pigment weight ratio of 7:3 and were kneaded together. After cooled, the kneaded mixture was pulverized in a feather mill. A pigment master batch was thus obtained.

Ninety three parts by weight of polyester resin, 10 parts by weight of the pigment master batch, and 2 parts by weight of a charge-controlling agent (E-84, a zinc-salicylate complex, made by Orient Kagaku Kogyo K.K.) were mixed in a Henschel mixer. The mixture was then kneaded in a vent twin screw kneader. After cooled, the kneaded mixture was pulverized roughly in a feather mill. The resulting particles being then pulverized in a jet mill. The pulverized particles were classified. Toner particles having a volume-mean particle size of 8.5 μm were obtained.

To the toner particles were added hydrophobic silica (H2000, made by Hoechst Japan K.K.) at 0.4% by weight, and hydrophobic titania (STT30A, made by Titan Kogyo K.K.) as an external additive at 0.6% by weight. The materials were mixed and treated in a Henschel mixer. A magenta toner c was thus obtained.

Experimental Example 1

Carriers A–L were respectively mixed with toner A in a ratio of 6% to toner a (T/C ratio) in a roll mill for one hour to give a developer. Then, the developer was subjected to durability test to repeat copy of an image of B/W 15% 100,000 times under an N/N environmental conditions (25° C., 50%) by using a copying machine EP-9765, made by Minolta K. K. A charging amount and fogging were evaluated at every 10,000 times of copy. Fog evaluation was visually made with respect to images formed on the sheet. Measurement results are shown in Table 2. The fog evaluation was ranked by marks ○, Δ, and x. Mark ○ shows that there is no problem for practical purposes; Δ shows that there is a slight problem; and x shows that fogging is noticeable and poses an image noise problem. Changes in the quantity of charge amount are shown in FIG. 1. With respect to carriers A–F and K, L of the present invention, it is clear that the change between the charge amount at the initial stage and after the durability test is small.

TABLE 2

| Carrier | Toner | 0 | 1 | 2 | 3 | 4 | 5 | 6 | 7 | 8 | 9 | 10 |
|---|---|---|---|---|---|---|---|---|---|---|---|---|
| A | a | 28.4 | 26.8 | 25.9 | 25.2 | 25.0 | 24.7 | 24.5 | 24.5 | 24.2 | 23.9 | 23.9 |
| | | ○ | ○ | ○ | ○ | ○ | ○ | ○ | ○ | ○ | ○ | ○ |
| B | a | 22.1 | 19.3 | 18.4 | 17.5 | 16.9 | 16.8 | 16.6 | 16.5 | 16.4 | 16.1 | 15.9 |
| | | ○ | ○ | ○ | ○ | ○ | ○ | ○ | ○ | ○ | ○ | ○ |
| C | a | 24.6 | 22.7 | 21.2 | 20.4 | 20.1 | 19.8 | 19.6 | 19.7 | 18.7 | 19.4 | 19.3 |
| | | ○ | ○ | ○ | ○ | ○ | ○ | ○ | ○ | ○ | ○ | ○ |
| D | a | 27.3 | 24.9 | 24.1 | 23.5 | 23.3 | 23.6 | 23.3 | 23.2 | 22.6 | 22.8 | 22.5 |
| | | ○ | ○ | ○ | ○ | ○ | ○ | ○ | ○ | ○ | ○ | ○ |
| E | a | 27.7 | 24.5 | 23.8 | 22.4 | 22.1 | 21.7 | 21.3 | 21.5 | 21.3 | 21.2 | 21.0 |
| | | ○ | ○ | ○ | ○ | ○ | ○ | ○ | ○ | ○ | ○ | ○ |
| F | a | 29.3 | 28.1 | 27.5 | 27.2 | 26.7 | 26.9 | 26.6 | 26.3 | 26.2 | 25.8 | 25.9 |
| | | ○ | ○ | ○ | ○ | ○ | ○ | ○ | ○ | ○ | ○ | ○ |
| G | a | 25.8 | 24.3 | 21.4 | 19.0 | 16.9 | 15.6 | 14.8 | 13.5 | 13.2 | 12.9 | 12.5 |
| | | ○ | ○ | ○ | Δ | Δ | Δ | x | x | x | x | x |
| H | a | 17.3 | 15.3 | 12.9 | 11.8 | 9.6 | 9.4 | 9.2 | 9.3 | 9.4 | 9.2 | 9.2 |
| | | ○ | Δ | x | x | x | x | x | x | x | x | x |
| I | a | 19.5 | 17.7 | 15.6 | 13.9 | 11.4 | 10.3 | 9.8 | 9.9 | 10.0 | 9.6 | 9.8 |
| | | ○ | ○ | ○ | x | x | x | x | x | x | x | x |
| J | a | 22.2 | 20.6 | 18.9 | 16.7 | 14.8 | 13.3 | 12.1 | 11.0 | 10.7 | 10.4 | 10.3 |
| | | ○ | ○ | ○ | Δ | Δ | x | x | x | x | x | x |
| K | a | 28.9 | 27.2 | 25.6 | 24.3 | 24.2 | 23.8 | 23.5 | 23.6 | 23.2 | 23.4 | 23.1 |
| | | ○ | ○ | ○ | ○ | ○ | ○ | ○ | ○ | ○ | ○ | ○ |
| L | a | 28.1 | 27.3 | 26.2 | 25.6 | 24.8 | 24.9 | 24.7 | 24.4 | 24.5 | 24.2 | 24.2 |
| | | ○ | ○ | ○ | ○ | ○ | ○ | ○ | ○ | ○ | ○ | ○ |

Upper: charge (μc/g),
Lower: fogging

Experimental Example 2

Carriers A–L were respectively were mixed with toner b in a T/C ratio of 6% in a roll mill for one hour to give a developer.

Figure 2:
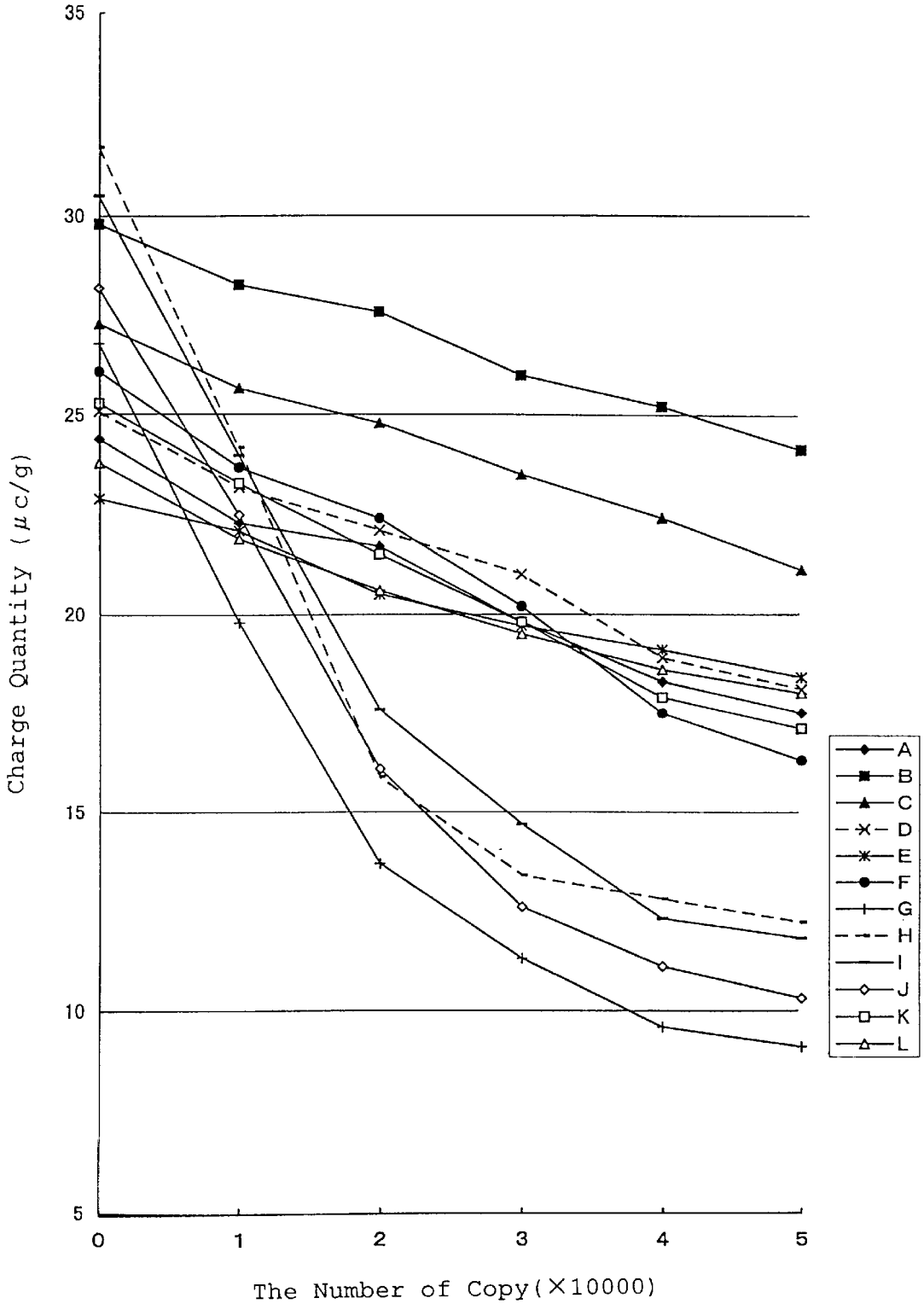
FIG. 2 is a graph showing changes in electrical charge amount of toner relative to the number of printed copy sheets in durability test.

Then, the developer was subjected to durability test to repeat copy of an image of B/W 15% 50,000 times under an N/N environmental conditions (25° C., 50%) by using a copying machine Di-30, made by Minolta K. K. A charging amount and fogging were evaluated at every 10,000 times of copy. Fog evaluation was visually made with respect to images formed on the sheet. Measurement results are shown in Table 3. The fog evaluation was ranked by marks ○, Δ, and x. Mark ○ shows that there is no problem for practical purposes; Δ shows that there is a slight problem; and x shows that fogging is noticeable and poses an image noise problem. Changes in the charge amount are shown in FIG. 2. With respect to carriers A–F and K, L of the present invention, it is clear that the change between the charge amount at the initial stage and after the durability test is small.

TABLE 3

| Carrier | Toner | 0 | 1 | 2 | 3 | 4 | 5 |
|---|---|---|---|---|---|---|---|
| A | b | 24.4 | 22.3 | 21.7 | 19.8 | 18.3 | 17.5 |
| | | ○ | ○ | ○ | ○ | ○ | ○ |
| B | b | 29.8 | 28.3 | 27.6 | 26.0 | 25.2 | 24.1 |
| | | ○ | ○ | ○ | ○ | ○ | ○ |
| C | b | 27.3 | 25.7 | 24.8 | 23.5 | 22.4 | 21.1 |
| | | ○ | ○ | ○ | ○ | ○ | ○ |
| D | b | 25.1 | 23.2 | 22.1 | 21.0 | 18.9 | 18.1 |
| | | ○ | ○ | ○ | ○ | ○ | ○ |
| E | b | 22.9 | 22.1 | 20.5 | 19.7 | 19.1 | 18.4 |
| | | ○ | ○ | ○ | ○ | ○ | ○ |
| F | b | 26.1 | 23.7 | 22.4 | 20.2 | 17.5 | 16.3 |
| | | ○ | ○ | ○ | ○ | ○ | ○ |
| G | b | 26.8 | 19.8 | 13.7 | 11.3 | 9.6 | 9.1 |
| | | ○ | ○ | x | x | x | x |
| H | b | 31.7 | 24.2 | 15.9 | 13.4 | 12.8 | 12.2 |
| | | ○ | ○ | Δ | x | x | x |
| I | b | 30.5 | 24.0 | 17.6 | 14.7 | 12.3 | 11.8 |
| | | ○ | ○ | Δ | Δ | x | x |
| J | b | 28.2 | 22.5 | 16.1 | 12.6 | 11.1 | 10.3 |
| | | ○ | ○ | ○ | x | x | x |
| K | b | 25.3 | 23.3 | 21.5 | 19.8 | 17.9 | 17.1 |
| | | ○ | ○ | ○ | ○ | ○ | ○ |
| L | b | 23.8 | 21.9 | 20.6 | 19.5 | 18.6 | 18.0 |
| | | ○ | ○ | ○ | ○ | ○ | ○ |

Upper: charge (μc/g),
Lower: fogging

Experimental Example 3

Carriers A–L were respectively were mixed with toner c in a T/C ratio of 6% in a roll mill for one hour to give a developer.

Then, the developer was subjected to durability test to repeat copy of an image of B/W 15% 30,000 times under an N/N environmental conditions (25° C., 50%) by using a copying machine CF-70, made by Minolta K. K. Fogging was evaluated at every 5,000 times of copy. Fog evaluation was visually made with respect to images formed on the sheet. The results are shown in Table 4. The fog evaluation was ranked by marks ○, Δ, and x. Mark ○ shows that there is no problem for practical purposes; Δ shows that there is a slight problem; and x shows that fogging is noticeable and poses an image noise problem.

TABLE 4

| Carrier | Toner | 0 | 0.5 | 1 | 1.5 | 2 | 2.5 | 3 |
|---|---|---|---|---|---|---|---|---|
| A | c | ○ | ○ | ○ | ○ | ○ | ○ | ○ |
| B | c | ○ | ○ | ○ | ○ | ○ | ○ | ○ |
| C | c | ○ | ○ | ○ | ○ | ○ | ○ | ○ |
| D | c | ○ | ○ | ○ | ○ | ○ | ○ | ○ |

TABLE 4-continued

| Carrier | Toner | 0 | 0.5 | 1 | 1.5 | 2 | 2.5 | 3 |
|---|---|---|---|---|---|---|---|---|
| E | c | ○ | ○ | ○ | ○ | ○ | ○ | ○ |
| F | c | ○ | ○ | ○ | ○ | ○ | ○ | ○ |
| G | c | ○ | ○ | ○ | Δ | x | x | x |
| H | c | ○ | ○ | ○ | ○ | Δ | x | x |
| I | c | ○ | ○ | ○ | ○ | Δ | x | x |
| J | c | ○ | ○ | ○ | Δ | Δ | x | x |
| K | c | ○ | ○ | ○ | ○ | ○ | ○ | ○ |
| L | c | ○ | ○ | ○ | ○ | ○ | ○ | ○ |

According to the present invention, carrier deterioration due to toner components can be prevented. Satisfactory images free of fogging can be formed.

What is claimed is:

1. A binder carrier comprising:

magnetic particles; and a binder resin including a thermoplastic silicone-modified acrylic resin comprising a polydiorgano siloxane represented by the following general formula (IV):

(IV)

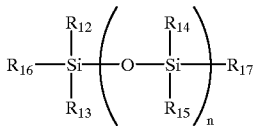

in which $R^{12}$–$R^{15}$ independently represent a monovalent hydrocarbon group; $R^{16}$ and $R^{17}$ independently represent a monovalent hydrocarbon group or hydroxyl group; and n denotes an integer of 1–500, and a copolymer resin of a polydiorgano-siloxane macromer having an acrylic functional group with a radical-polymerizable organic monomer.

2. The binder carrier as set forth in claim 1, in which the polydiorgano-siloxane macromer having the acrylic functional group is a polydiorgano siloxane represented by the following general formula (I):

(I)

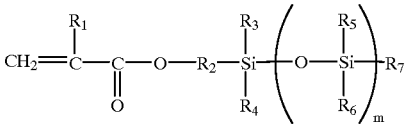

in which, $R^1$ represents a hydrogen atom or an alkyl group; $R^2$ represents an alkylene group; $R^3$–$R^6$ independently represent a monovalent hydrocarbon group; and $R^7$ represents a group selected from the group consisting of a monovalent hydrocarbon group, a hydroxyl group, and an acrylic functional group represented by the following general formula (II):

(II)

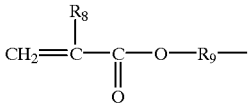

in which, $R^8$ represents a hydrogen atom or an alkyl group; and $R^9$ represents an alkylene group; and m denotes an integer of 1–500.

3. The binder carrier as set forth in claim 2, in which $R^1$ is a C1 to C4 alkyl group, $R^2$represents a C1 to C5 alkylene group; $R^3$–$R^6$ independently represent a C1 to C4 alkyl group.

4. The binder carrier as set forth in claim 1, in which the radical-polymerizable organic monomer is an acrylic organic monomer represented by the following general formula (III):

(III)

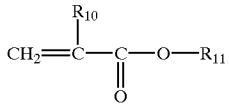

in which, $R^{10}$ represents a hydrogen atom or an alkyl group; and $R^{11}$ represents a monovalent hydrocarbon group.

5. The binder carrier as set forth in claim 1, in which the copolymer resin is produced by copolymerizing, in the presence of the polydiorgano siloxane, the polydiorgano-siloxane macromer having an acrylic functional group which is represented by the following general formula (I):

(I)

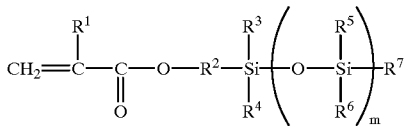

in which, $R^1$ represents a hydrogen atom or an alkyl group; $R^2$ represents an alkylene group; $R^3$–$R^6$ independently represent a monovalent hydrocarbon group; and $R^7$ represents a group selected from the group consisting of a monovalent hydrocarbon group, a hydroxyl group, and an acrylic functional group represented by the following general formula (II):

(II)

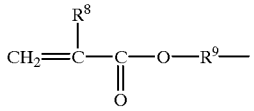

in which, $R^8$ represents a hydrogen atom or an alkyl group; and $R^9$ represents an alkylene group; and m denotes an integer of 1–500, and an acrylic organic monomer represented by the following general formula (III):

(III)

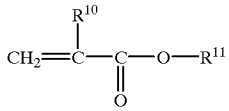

in which, $R^{10}$ represents a hydrogen atom or an alkyl group; and $R^{11}$ represents a monovalent hydrocarbon group.

6. The binder carrier as set forth in claim 5, in which the silicone-modified acrylic resin has a ratio (Mac/Msi) of a repeating unit (Mac) expressed by the following formula:

(Mac)

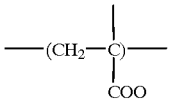

to a repeating unit (Msi) expressed by the following formula:

(Msi)

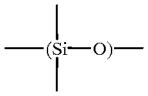

of 1/4 to 4/1.

7. The binder carrier as set forth in claim 1, in which a content of the silicone-modified acrylic resin is 5 to 70% by weight relative to the binder resin.

8. The binder carrier as set forth in claim 7, in which the binder resin is at least one kind of resin selected from the group consisting of polyester resins, styrene-acryl copolymer resins, poly(meth)acrylic resins, and epoxy resins.

9. The binder carrier as set forth in claim 7, in which a content of the silicone-modified acrylic resin is 10 to 50% by weight relative to the binder resin.

10. The binder carrier as set forth in claim 1, in which the magnetic particles are contained at a content of 100 to 900 parts by weight on the basis of 100 parts by weight of the binder resin.

11. The binder carrier as set forth in claim 1, in which the carrier has a volume-mean particle size of 20 to 100 $\mu$m.

12. The binder carrier as set forth in claim 1, in which the carrier has a saturation magnetization level of 30 to 80 emu/g.

13. A developer, comprising:

a toner; and a binder carrier comprising magnetic particles and a binder resin including a thermoplastic silicone-modified acrylic resin comprising a polydiorgano siloxane represented by the following general formula (IV):

(IV)

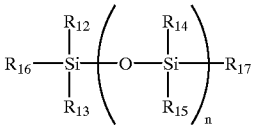

in which, $R^{12}$–$R^{15}$ independently represent a monovalent hydrocarbon group, $R^{16}$ and $R^{17}$ independently represent a monovalent hydrocarbon group or hydroxyl group, and n denotes an integer of 1–500, and a copolymer of a polydiorgano-siloxane macromer having an acrylic functional group with a radical-polymerizable organic monomer.

14. The developer as set forth in claim 13, in which the polydiorgano-siloxane macromer having the acrylic functional group is a polydiorgano siloxane represented by the following general formula (I):

(I)

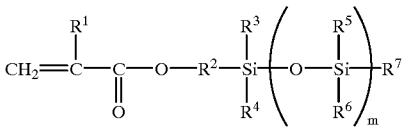

in which, $R^1$ represents a hydrogen atom or an alkyl group; $R^2$ represents an alkylene group; $R^3$–$R^6$ independently represent a monovalent hydrocarbon group; and $R^7$ represents a group selected from the group consisting of a monovalent hydrocarbon group, a hydroxyl group, and an acrylic functional group represented by the following general formula (II):

(II)

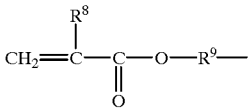

in which, $R^8$ represents a hydrogen atom or an alkyl group; and $R^9$ represents an alkylene group; and m denotes an integer of 1–500.

15. The developer as set forth in claim 13, in which the radical-polymerizable organic monomer is an acrylic organic monomer represented by the following general formula (III):

(III)

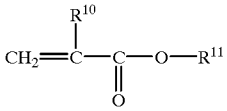

in which, $R^{10}$ represents a hydrogen atom or an alkyl group; and $R^{11}$ represents a monovalent hydrocarbon group.

16. The developer as set forth in claim 13, in which the toner is contained at a content of 3 to 20% by weight relative to the developer.

17. A binder carrier comprising:

magnetic particles; and a binder resin including a thermoplastic silicone-modified acrylic resin, wherein the carrier has a saturation magnetization level of 30 to 80 emu/g.

18. The binder carrier as set forth in claim 17, in which the saturation magnetization level is 35 to 65 emu/g.

19. The binder carrier as set forth in claim 17, in which the carrier has a volume-mean particle size of 30 to 80 $\mu$m.

20. The binder carrier as set forth in claim 17, in which the magnetic particles are contained at a content of 300 to 700 parts by weight on the basis of 100 parts by weight of the binder resin.

21. A developer comprising:

a toner; and a binder carrier comprising magnetic particles and a binder resin including a thermoplastic silicone-modified acrylic resin, wherein the toner is contained at a content of 3 to 20% by weight relative to the developer.

22. The developer as set forth in claim 21, in which the toner is contained at a content of 5 to 10% by weight relative to the developer.

23. The developer as set forth in claim 21, in which the binder carrier has a saturation magnetization level of 30 to 80 emu/g.

24. The developer as set forth in claim 21, in which the binder carrier has a volume-mean particle size of 30 to 80 $\mu$m.

25. The developer as set forth in claim 21, in which the magnetic particles are contained at a content of 300 to 700 parts by weight on the basis of 100 parts by weight of the binder resin.

* * * * *